US005936316A

United States Patent [19]

Jurkiewicz et al.

[11] Patent Number: 5,936,316

[45] Date of Patent: Aug. 10, 1999

[54] VEHICLE IGNITION SWITCH HAVING COMBINED RUN AND START POSITION

[75] Inventors: James S. Jurkiewicz, Macomb; Stephen L. Hyde, Clarkston, both of Mich.

[73] Assignee: DaimlerChrysler Corporation, Auburn Hills, Mich.

[21] Appl. No.: 08/862,049

[22] Filed: May 22, 1997

[51] Int. Cl.[6] ..... F02N 11/08

[52] U.S. Cl. ..... 307/10.6; 123/179.3

[58] Field of Search ..... 307/10.1–10.6; 290/38 C; 123/179.1–179.3

[56] References Cited

U.S. PATENT DOCUMENTS

| | | | |
|---|---|---|---|
| 2,560,094 | 7/1951 | Dodge . | |
| 3,612,893 | 10/1971 | Gallagher . | |
| 3,629,598 | 12/1971 | Rachel . | |
| 3,643,044 | 2/1972 | Batchller . | |
| 3,863,077 | 1/1975 | Bienkowski . | |
| 3,885,543 | 5/1975 | Swartz . | |
| 4,104,688 | 8/1978 | Pecsi . | |
| 4,209,816 | 6/1980 | Hansen . | |
| 4,227,588 | 10/1980 | Biancardi | 123/179.2 |
| 4,292,483 | 9/1981 | Roytherg . | |
| 4,659,883 | 4/1987 | Poschet . | |
| 4,878,465 | 11/1989 | Hanson et al. | 290/38 C |
| 5,441,022 | 8/1995 | Yoder et al. . | |
| 5,479,909 | 1/1996 | Blakeslee et al. | 123/179.1 |
| 5,564,375 | 10/1996 | Orzal . | |

*Primary Examiner*—Richard T. Elms
*Attorney, Agent, or Firm*—Roland A. Fuller, III

[57] ABSTRACT

An ignition switch system is provided for use with an engine of a vehicle. The ignition switch system includes a power source such as a battery, and an ignition switch connected to the power source. The ignition switch includes an off position and a combined run and start position. A controller is electrically connected to the ignition switch. A relay mechanism is electrically connected to the controller. A starter mechanism is electrically connected to the relay mechanism and is drivingly engageable with the engine of the vehicle. The ignition switch connects the power source to the controller when the ignition switch is in the combined run and start position. The controller, upon connection with the power source, determines if the engine is running. If the engine is not running, the controller activates the relay mechanism which engages the starter mechanism to the power source. If the controller determines that the engine is running, the controller deactivates the relay in order to disable the starter mechanism.

5 Claims, 2 Drawing Sheets

VEHICLE IGNITION SWITCH HAVING COMBINED RUN AND START POSITION

BACKGROUND OF THE INVENTION

FIELD OF THE INVENTION

The present invention relates to an ignition switch system, and more particularly, to a method and system for incorporating an ignition switch which has no integral return spring and therefore does not return from the start to the run position when operated by a vehicle operator.

BACKGROUND AND SUMMARY OF THE INVENTION

Nearly all automobiles on the market today are operated using a key ignition switch system. As shown in FIG. 3, the conventional ignition switch systems include an ignition switch 10 connected to a power source such as a battery 12 via an electrical wire 14. A typical ignition switch 10 includes an accessory position 10*a*, a lock position 10*b*, an unlock position 10*c*, a run position 10*d*, and a start position 10*e*. When the ignition switch is in the lock position 10*b*, all of the vehicle systems are typically disabled. When the key is turned to the accessory position 10*a* or run position 10*d*, the vehicle accessories, such as the sound system and power windows are connected to the battery 12 so that they can be operated when the vehicle is not running. When the ignition switch is rotated from the lock position 10*b* to the unlocked position 10*c*, the steering column is released from a locked condition. When the key is turned further to the run position 10*d*, the ignition switch 10 provides a connection between the battery 12 and an engine controller 16 by electrical wire 18 in addition to connecting the accessory systems.

When the key is turned to the start position 10*e*, a connection is made between the battery 12 and the engine controller 16 by electrical wire 20. In addition, a relay mechanism 22 may also be actuated by receiving electrical power through electrical wire 20*a*. The delivery of electrical power to the relay device 22 depends upon whether the engine controller 16 has opened or closed the switch 24 for completing the circuit through the relay device 22. If the switch 24 is closed by the engine controller 16, then an electrical signal can be delivered to the relay device 22 which actuates the switch 26. The actuated switch 26 provides electrical power by electrical wires 30, 32 to engage the starter motor solenoid. As the solenoid engages, electrical power to drive the starter motor 28 is supplied through electrical wire 34.

Current systems utilized by the Assignee of the present invention have an engine controller 16 which determines whether the engine is running, and if so, opens switch 24 so that the relay device 22 can not be actuated. Thus, the starter motor 28 cannot be actuated if the engine is running. Therefore, the problem of double starting is avoided. Typically, in a system as described above, the ignition switch is turned via a key to the run position and the vehicle operator is accustomed to releasing the key when he senses that the engine is running. The ignition switch is spring biased so as to return to the run position 10*d*.

Although the problem is uncommon, there have been instances in the conventional key ignition systems where the ignition key sticks in the start position which can cause damage to the starter and other components and/or prevent the proper circuits from either making or breaking. These problems arise due to the ignition switch spring, which returns the key from the start position back to the run position, being insufficient to overcome added system torques which intermittently develop due to various stack-ups. These stack-ups include added ignition key tumbler torques due to forces being applied to the key cylinder housing by the column lock-housing in addition to individual component torques due to insufficient or inconsistent lube application. Simply enlarging the spring is not feasible due to potential "fly back" issues, wherein the ignition switch is returned past the run position 10*d* to the unlock position 10*c* wherein the engine is disabled. In addition, enlarging the spring also increases the efforts required to turn the key to start the engine. For many drivers with arthritis or some other wrist, hand, or finger disability, an ignition system with minimal spring resistance can cause substantial pain and discomfort.

Accordingly, the system of the present invention provides a method and a system for incorporating an ignition switch which has no integral return spring and therefore does not return from the "start" to the "run" position when operated by the driver. The system of the present invention provides improved ergonomic feel and efforts resulting in a more user-friendly experience for drivers with arthritis or some other wrist, hand, or finger disability. The system provides a simpler ignition system design which is not susceptible to system drags as experienced with conventional spring loaded ignition switches, in addition to replacing the complicated internal ignition switch mechanical lift ramps and contact system with one which is much simpler due to electronics controlling all circuit make/breaks as opposed to the ignition switch making these connections.

The present invention provides an ignition switch system for use with an engine of a vehicle. The ignition switch system includes a power source such as a battery, and an ignition switch connected to the power source. The ignition switch includes an off position and a combined run and start position. A controller is electrically connected to the ignition switch. A relay mechanism is electrically connected to the controller. A starter mechanism is electrically connected to the relay mechanism and is drivingly engageable with the engine of the vehicle. The ignition switch connects the power source to the controller when the ignition switch is in the combined run and start position. The controller, upon connection with the power source, determines if the engine is running. If the engine is not running, the controller activates the relay mechanism which engages the starter solenoid which engages the starter motor to the power source. If the controller determines that the engine is running, the controller deactivates the relay in order to disable the starter, and enables all "run" circuits.

The system of the present invention greatly simplifies the ignition switch design by eliminating various mechanical circuit timing functions. In addition, the sticky key issue as well as the fly back issue are avoided. The system of the present invention improves ergonomic feel and efforts and is therefore more user friendly for drivers with arthritis or other ailments. The engine controller of the present invention can also be programmed for optimal starter functioning in order to reduce the wear on the starter due to reduced on time and due to consistent operation. The system of the present invention can also lead to reduced wiring requirements by eliminating circuits which are required for the conventional ignition switch systems. Finally, a simplified ignition switch can be utilized due to the elimination of complicated mechanical lift ramps and contacts.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
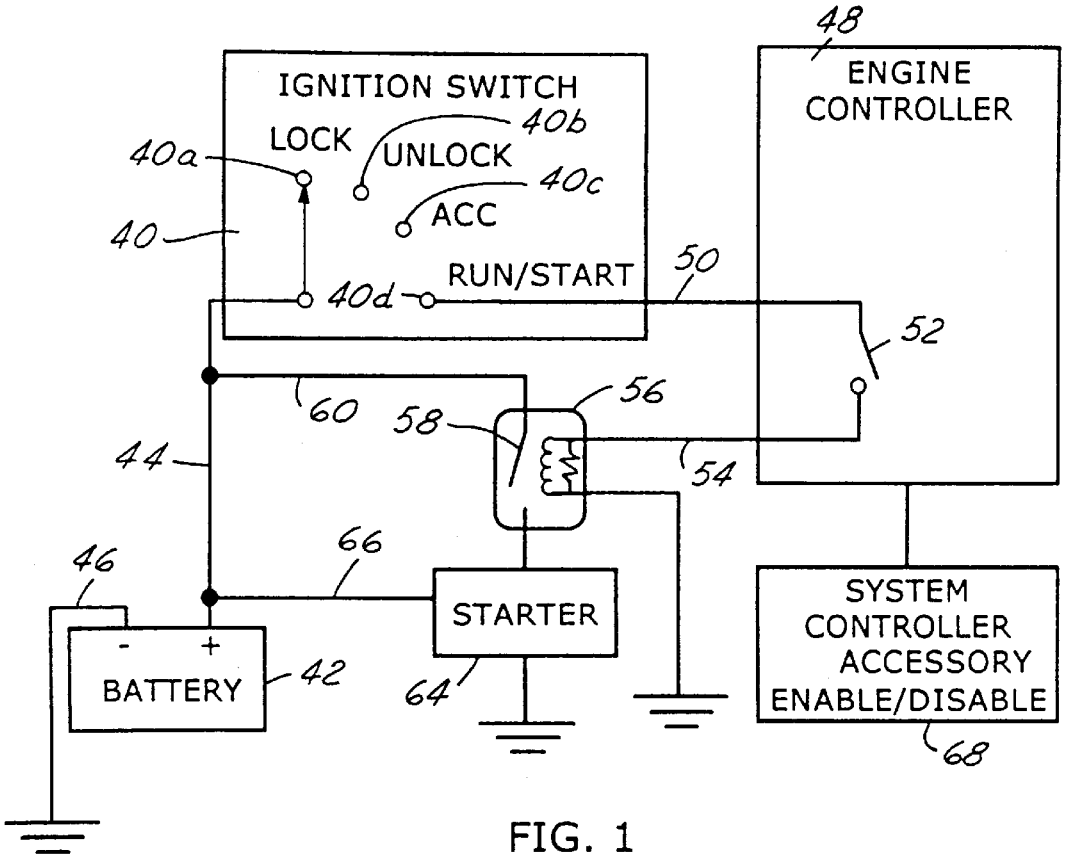
FIG. 1 is a circuit diagram illustrating a preferred embodiment of the ignition switch system according to the present invention.
Figure 3:
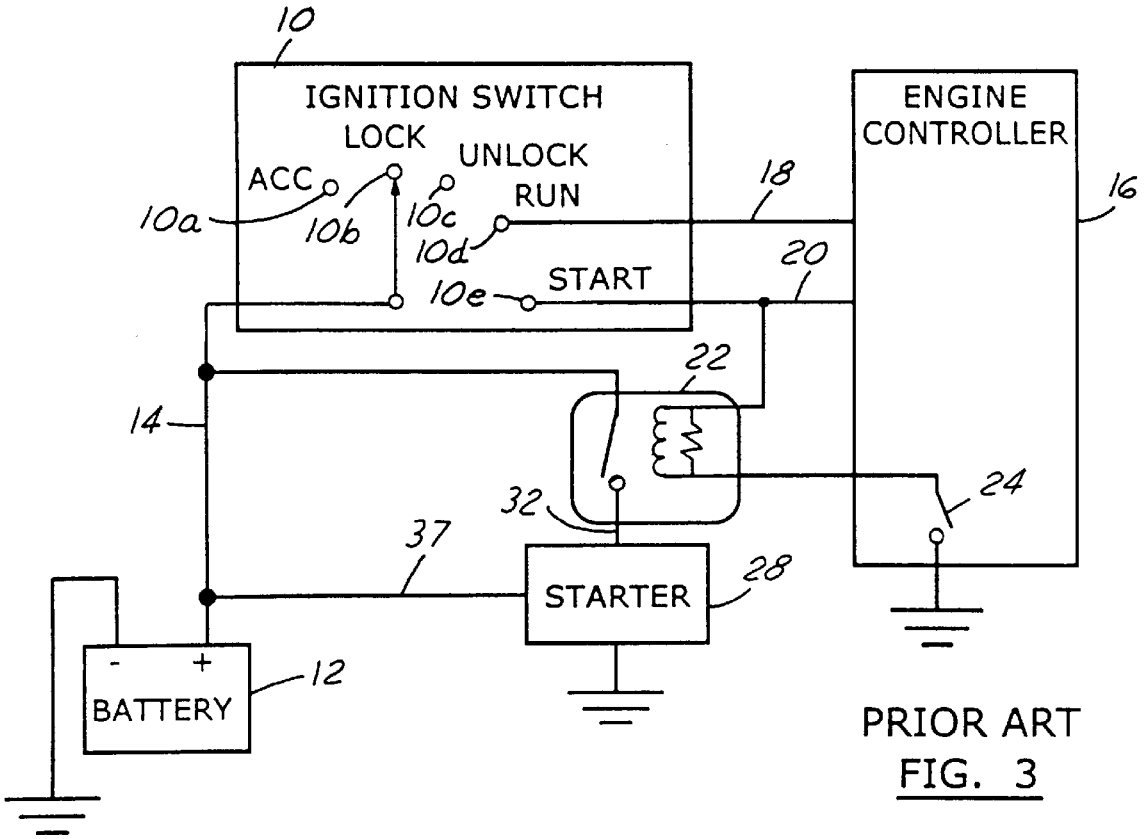
PRIOR ART FIG. 3
FIG. 3 is a circuit diagram of a known double start override system.
Figure 2:
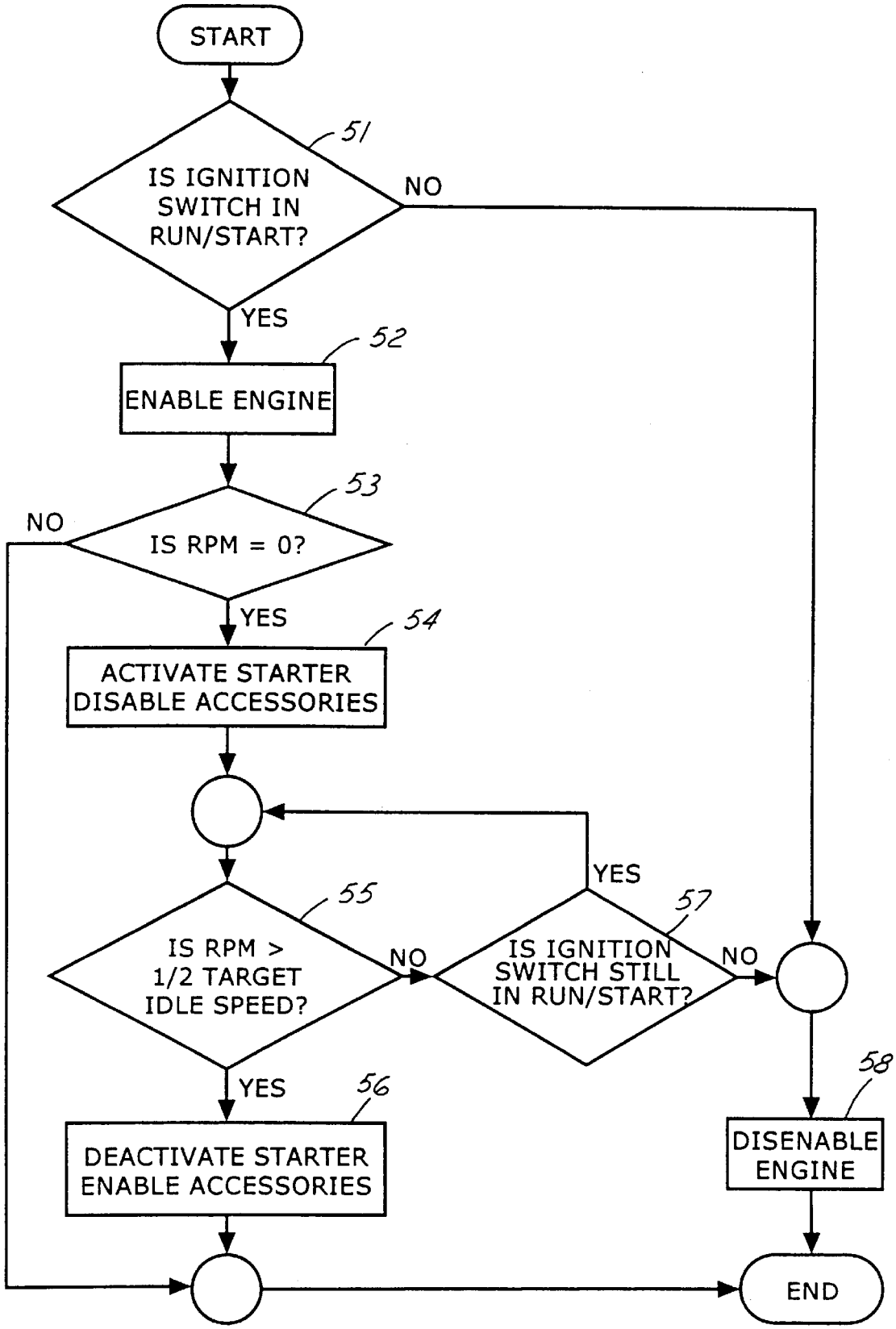
FIG. 2 is a flow chart illustrating the control logic utilized by the engine controller according to a preferred embodiment of the present invention.

With reference to FIGS. 1 and 2, an ignition switch system according to a preferred embodiment of the present invention will be described. The ignition switch system includes an ignition switch 40 connected to a power source such as a battery 42, by electrical wire 44. The battery 42 is provided with a negative terminal which is connected to ground by wire 46. The ignition switch 40 is connected to an engine controller 48 by electrical wire 50. Engine controller 48 includes a switch 52 which is operated by the engine controller 48 for providing an electrical signal through electrical wire 54 to relay device 56. Relay device 56 is a standard relay device which is known in the art. Relay device 56 includes a switch 58 which can be closed to actuate the starter motor solenoid through electrical wires 60 and 62. The actuation of the solenoid mechanically engages the starter motor 64 to the engine and also connects power to the starter motor through electrical wire 66. Conventional starting operation is initiated with an engine of a vehicle (not shown).

The ignition switch 40 is provided with a lock position 40*a*, wherein the steering column (not shown) is in a locked condition and the main vehicle electronics systems are disconnected from the battery 42. The ignition switch 40 also includes an unlock position 40*b*, wherein the steering column is unlocked. The ignition switch 40 further includes an accessory position 40*c*, wherein the vehicle accessories such as the sound system and power windows are connected to the battery 42 for operation. Finally, the ignition switch 40 includes a combined run/start position 40*d*. When the ignition switch 40 is in the combined run/start position 40*d*, electrical wire 44 is connected with electrical wire 50 for providing power from the battery 42 to the engine controller 48.

With reference to FIG. 2, the control logic carried out by the engine controller 48 will be described. When the connection between the battery 42 and the engine controller 48 is made, the engine controller 48 recognizes that the ignition switch 40 is in the run/start position 40*d* (S1). The engine controller 48 then enables the engine (S2). The engine controller 48 then determines if the engine is running by determining whether the engine rpm is equal to zero (S3). If the engine rpm is equal to zero, the engine controller 48 directs a system controller 68 to disable all "run only" circuits and closes switch 52 in order to activate the starter 64 (S4). The engine controller 48 then determines if the engine rpm is greater than one half the target engine idle speed (S5). It should be noted that the rotation speed of the starter motor 64 is typically substantially less than the target engine idle speed. Therefore, a determination that the engine rpm is greater than the maximum starter motor speed would be a sufficient indicator that the engine is running. If the engine controller 48 determines that the engine is running, the starter 64 is deactivated and the system controller 68 is directed to enable all "run only" circuits (S6). If the engine controller 48 determines that the engine speed is not greater than a predetermined speed (one half the target engine idle speed in the preferred embodiment), the engine controller 48 determines if the ignition switch 40 is still in the combined run/start position 40*d* (S7). If the ignition switch 40 is still in the run/start position 40*d*, the engine controller returns to step (S5) to determine if the engine rpm is greater than one half the target engine idle speed. This is continued until the engine is running with sufficient speed; at which time, the starter 64 is deactivated and the accessories are enabled (S6). If the engine controller 48 determines that the ignition switch 40 is no longer in the run/start position, the engine is disabled (S8).

The above-described system utilizes the engine controller 48 to enable and disable the starter motor 64 in such a way that the ignition switch 40 can be provided with a single position for starting the vehicle engine and can maintain the engine in a running mode. This system of the present invention provides an improved ergonomic ignition switch system which is simpler in design than conventional systems.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ignition switch system for use with an engine of a vehicle, comprising:

a power source;

an ignition switch connected to said power source, said ignition switch having an off position and a combined run and start position;

a controller electrically connected to said ignition switch;

a relay mechanism electrically connected to said controller; and a starter mechanism electrically connected to said relay mechanism, said starter mechanism being drivingly engageable with said engine;

wherein said ignition switch connects said power source to said controller when said ignition switch is in said combined run and start position, said controller upon connection with said power source determines if said engine is running, and if said engine is determined to be not running, said controller activates said relay mechanism which engages said starter mechanism to said power source.

2. The ignition switch system according to claim 1, wherein if said controller determines that said engine is running, then said controller deactivates said relay in order to disable said starter mechanism.

3. The ignition switch system according to claim 1, wherein when said starter mechanism is engaged with said power source, vehicle accessories are disabled.

4. The ignition switch system according to claim 2, wherein when said start mechanism is disabled, vehicle accessories are enabled.

5. An ignition switch system for use with an engine of a vehicle comprising:

a power source;

an ignition switch connected to said power source, said ignition switch having an off position and a combined run and start position;

an engine controller electrically connected to said ignition switch;

a relay mechanism electrically connected to said engine controller; and a starter mechanism electrically connected to said relay mechanism, said starter mechanism being drivingly engageable with said engine;

wherein said ignition switch connects said power source to said engine controller when said ignition switch is in said combined run and start position, said engine controller upon connection with said power source determines if said engine is running, and if said engine is determined to be not running, said engine controller activates said relay mechanism which engages said starter mechanism to said power source;

wherein when said relay mechanism engages said starter mechanism to said power source, said engine controller determines an engine speed of said engine, and if said engine speed is greater than one half of a target engine idle speed, said engine controller deactivates said relay mechanism in order to disable said starter mechanism.

* * * * *